US006953258B1

(12) United States Patent
Goins

(10) Patent No.: US 6,953,258 B1
(45) Date of Patent: Oct. 11, 2005

(54) MAILBOX LIGHT ASSEMBLY

(76) Inventor: John W. Goins, 701 Chavis Ave., Greensboro, NC (US) 27401

( * ) Notice: Subject to any disclaimer, the term of this patent is extended or adjusted under 35 U.S.C. 154(b) by 0 days.

(21) Appl. No.: 10/441,311

(22) Filed: May 19, 2003

(51) Int. Cl.[7] ..... F21V 33/00

(52) U.S. Cl. ..... 362/155; 362/253; 362/396; 40/566

(58) Field of Search ..... 362/155, 396, 362/253, 234, 374, 375, 190, 157, 154, 802; 232/13, 17, 34, 38, 39; 40/566, 606.06

(56) References Cited

U.S. PATENT DOCUMENTS

| | | | | |
|---|---|---|---|---|
| 1,819,398 A | | 8/1931 | Wegehoft | |
| D221,361 S | | 8/1971 | Parker | |
| 4,154,393 A | | 5/1979 | Darvishian | |
| 4,182,479 A | * | 1/1980 | Swift | 232/34 |
| 4,648,012 A | * | 3/1987 | Pittman, II | 362/155 |
| 5,032,957 A | | 7/1991 | Canfield | |
| 5,239,305 A | * | 8/1993 | Murphy et al. | 340/539.1 |
| 5,813,749 A | | 9/1998 | Sheldon | |
| 5,975,713 A | * | 11/1999 | Brothers | 362/155 |
| 6,601,969 B2 | * | 8/2003 | Barton | 362/155 |

* cited by examiner

*Primary Examiner*—John Anthony Ward
*Assistant Examiner*—Bao Q. Truong

(57) ABSTRACT

A mailbox light assembly for illuminating an inside of a standard mailbox upon opening of the mailbox's door. The mailbox light assembly includes housing, a light source, a power source and a normally closed pushbutton door switch. The housing has an upper surface that is designed to abut a top inside surface of a standard mailbox. A pair of clips is used to couple the housing to the top inside surface of the mailbox. The light source provides illumination to an inside of the mailbox and is positioned in the housing. The power source provides power to the light source and is also positioned in the housing. The door switch is electrically coupled between the light source and the power source and is activated when a door of the mailbox is not covering an opening to the mailbox.

13 Claims, 2 Drawing Sheets

MAILBOX LIGHT ASSEMBLY

BACKGROUND OF THE INVENTION

1. Field of the Invention

The present invention relates to mailbox lighting devices and more particularly pertains to a new mailbox light assembly for illuminating an inside of a standard mailbox upon opening of the mailbox's door.

2. Description of the Prior Art

The use of mailbox lighting devices is known in the prior art. More specifically, mailbox lighting devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,648,012; U.S. Pat. No. 4,154,393; U.S. Pat. No. 1,819,398; U.S. Pat. No. 5,813,749; U.S. Pat. No. 5,032,957; and U.S. Pat. No. Des. 221,361.

While these devices fulfill their respective, particular objectives and requirements, the aforementioned patents do not disclose a new mailbox light assembly. The inventive device includes housing, a light source, a power source and a normally closed pushbutton door switch. The housing has an upper surface that is designed to abut a top inside surface of a standard mailbox. A pair of clips is used to couple the housing to the top inside surface of the mailbox. The light source provides illumination to an inside of the mailbox and is positioned in the housing. The power source provides power to the light source and is also positioned in the housing. The door switch is electrically coupled between the light source and the power source and is activated when a door of the mailbox is not covering an opening to the mailbox.

In these respects, the mailbox light assembly according to the present invention substantially departs from the conventional concepts and designs of the prior art, and in so doing provides an apparatus primarily developed for the purpose of illuminating an inside of a standard mailbox upon opening of the mailbox's door.

SUMMARY OF THE INVENTION

In view of the foregoing disadvantages inherent in the known types of mailbox lighting devices now present in the prior art, the present invention provides a new mailbox light assembly construction wherein the same can be utilized for illuminating an inside of a standard mailbox upon opening of the mailbox's door.

The general purpose of the present invention, which will be described subsequently in greater detail, is to provide a new mailbox light assembly apparatus and method which has many of the advantages of the mailbox lighting devices mentioned heretofore and many novel features that result in a new mailbox light assembly which is not anticipated, rendered obvious, suggested, or even implied by any of the prior art mailbox lighting devices, either alone or in any combination thereof.

To attain this, the present invention generally comprises housing, a light source, a power source and a normally closed pushbutton door switch. The housing has an upper surface that is designed to abut a top inside surface of a standard mailbox. A pair of clips is used to couple the housing to the top inside surface of the mailbox. The light source provides illumination to an inside of the mailbox and is positioned in the housing. The power source provides power to the light source and is also positioned in the housing. The door switch is electrically coupled between the light source and the power source and is activated when a door of the mailbox is not covering an opening to the mailbox.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new mailbox light assembly apparatus and method which has many of the advantages of the mailbox lighting devices mentioned heretofore and many novel features that result in a new mailbox light assembly which is not anticipated, rendered obvious, suggested, or even implied by any of the prior art mailbox lighting devices, either alone or in any combination thereof.

It is another object of the present invention to provide a new mailbox light assembly which may be easily and efficiently manufactured and marketed.

It is a further object of the present invention to provide a new mailbox light assembly which is of a durable and reliable construction.

An even further object of the present invention is to provide a new mailbox light assembly which is susceptible of a low cost of manufacture with regard to both materials and labor, and which accordingly is then susceptible of low prices of sale to the consuming public, thereby making such mailbox light assembly economically available to the buying public.

Still yet another object of the present invention is to provide a new mailbox light assembly which provides in the apparatuses and methods of the prior art some of the advantages thereof, while simultaneously overcoming some of the disadvantages normally associated therewith.

Still another object of the present invention is to provide a new mailbox light assembly for illuminating an inside of a standard mailbox upon opening of the mailbox's door.

Yet another object of the present invention is to provide a new mailbox light assembly which includes housing, a light source, a power source and a normally closed pushbutton door switch. The housing has an upper surface that is designed to abut a top inside surface of a standard mailbox. A pair of clips is used to couple the housing to the top inside surface of the mailbox. The light source provides illumination to an inside of the mailbox and is positioned in the housing. The power source provides power to the light source and is also positioned in the housing. The door switch is electrically coupled between the light source and the power source and is activated when a door of the mailbox is not covering an opening to the mailbox.

Still yet another object of the present invention is to provide a new mailbox light assembly that is easy to attach to a standard mailbox.

Even still another object of the present invention is to provide a new mailbox light assembly that provides safety by illuminating the objects in a mailbox.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
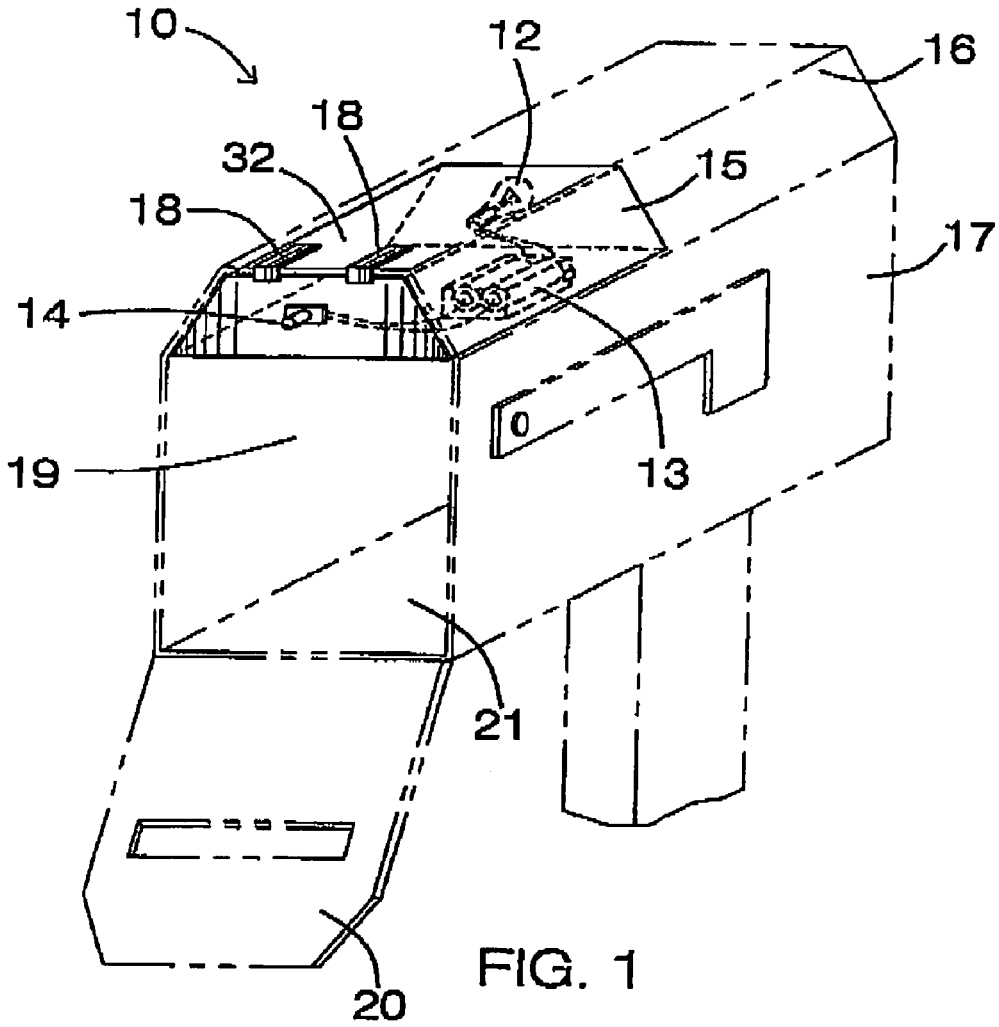
FIG. 1 is a schematic perspective view of a new mailbox light assembly according to the present invention, illustrating its use with a standard mailbox.
Figure 2:
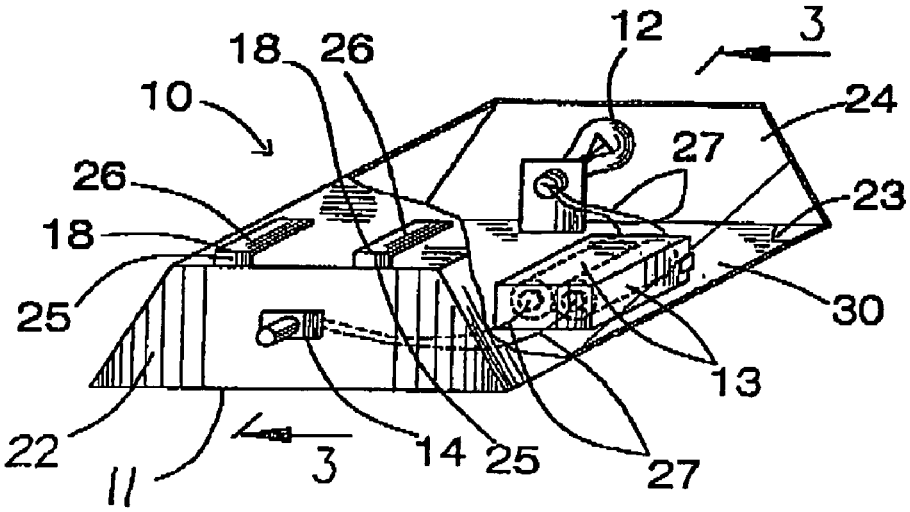
FIG. 2 is a schematic cut-out view of the present invention.
Figure 3:
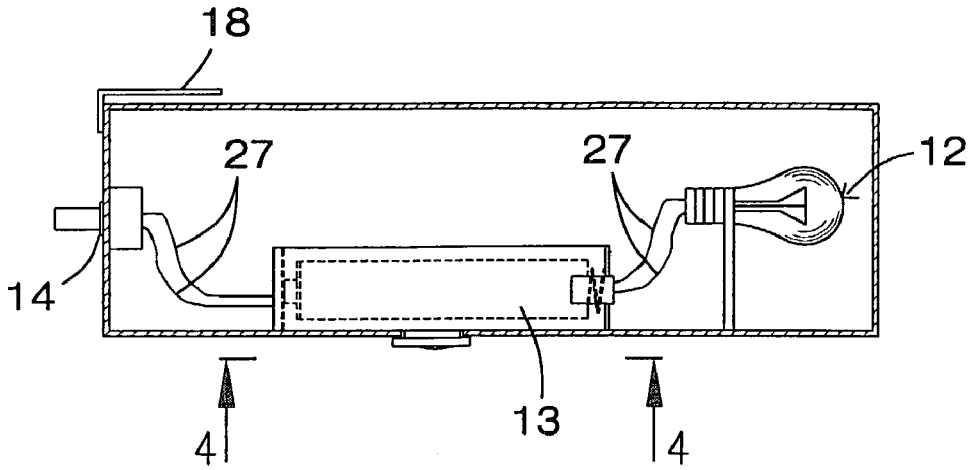
FIG. 3 is a schematic cross-sectional side view of the present invention.
Figure 4:
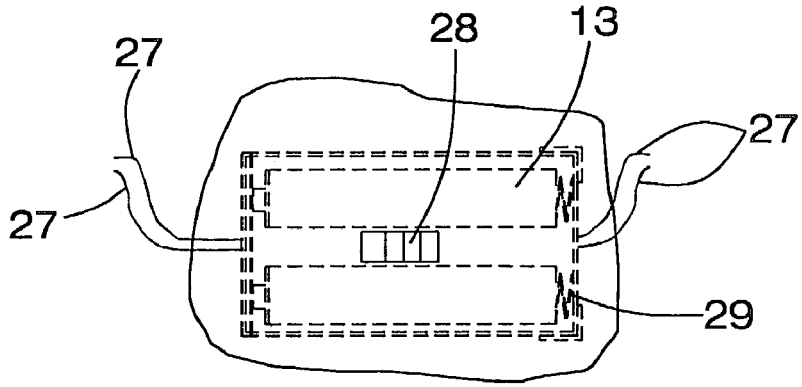
FIG. 4 is a schematic bottom view of the present invention, illustrating the battery compartment.
Figure 5:
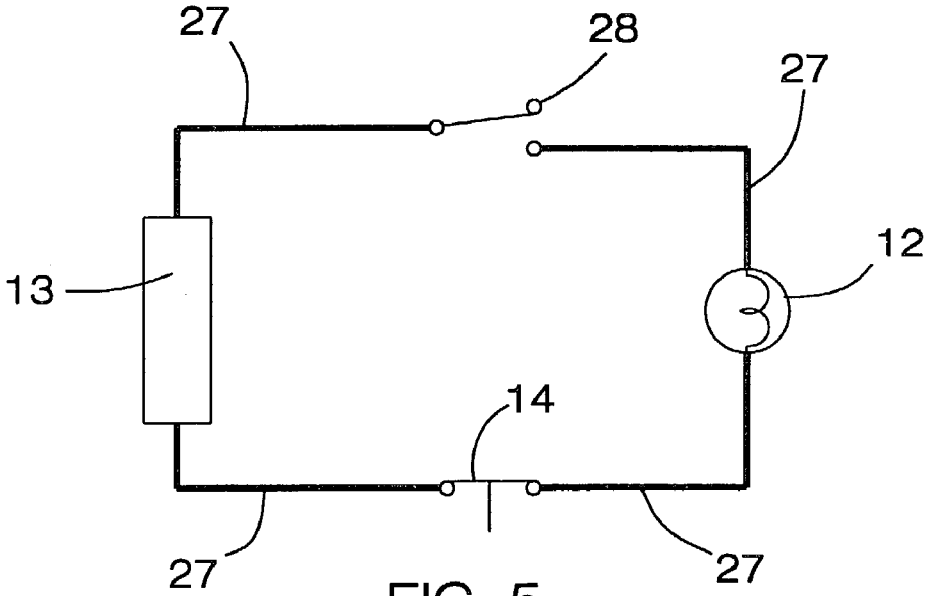
FIG. 5 is a schematic diagram of the electronic components of the present invention.

With reference now to the drawings, and in particular to FIGS. 1 through 5 thereof, a new mailbox light assembly embodying the principles and concepts of the present invention and generally designated by the reference numeral 10 will be described.

As best illustrated in FIGS. 1 through 5, the mailbox light assembly 10 generally comprises housing 11, a light source 12, a power source 13 and a normally closed pushbutton door switch 14. The housing 11 has an upper surface 15 that is designed to abut a top inside surface 16 of a standard mailbox 17. A pair of clips 18 is used to couple the housing 11 to the top inside surface 16 of the mailbox 17. The light source 12 provides illumination to an inside 19 of the mailbox 17 and is positioned in the housing 11. The power source 13 provides power to the light source 12 and is also positioned in the housing 11. The door switch 14 is electrically coupled between the light source 12 and the power source 13 and is activated when a door 20 of the mailbox 17 is not covering an opening 21 to the mailbox 17.

In closer detail, the housing 11 further has a front wall 22, a bottom wall 23, and an open back portion 24. The clips 18 have a first portion 25 that extends from the front wall 22 of the housing 11 proximate the upper surface of the housing 15. Each clip 18 has a second portion 26 for engaging an outside surface 32 of the mailbox 17. The second portion 26 is coupled generally perpendicular to the first portion 25 proximate the upper surface 15 of the housing 11. Moreover, the second portion 26 is positioned generally parallel to the upper surface 15 of the housing 11. In addition, the clips 18 are spaced a predetermined distance apart from each other.

The light source 12 is positioned in the housing 11 proximate the back portion 24 of the housing 11. Moreover, the power source 13 is in electrical communication with the light source 12 by a pair of electrical wires 27.

The door switch 14 extends from the front wall 22 of the housing 11. The door switch 14 is further positioned to engage the door 20 of the mailbox 17 when the door 20 is covering the opening 21 to the inside 19 of the mailbox 17. Thus when the door 20 is covering the opening 21 to the inside 19 of the mailbox 17, the door switch 14 is open thereby deactivating the light source 14. Moreover, when the door 20 is not covering the opening 21 to the inside of the mailbox 17, the door switch 14 is closed thereby activating the light source 12.

The mailbox light assembly 10 also has an on/off switch 28 for disconnecting the power source 13 from the light source 14 to conserve energy of the power source 13 when not in use. A pair of electrical wires 27 electrically couples the on/off switch 28 between the power source 13 and the light source 14. The on/off switch 28 extends from the bottom wall 23 of the housing 11 thereby allowing manipulation of the on/off switch 28.

A battery compartment 29 is used to hold the power source 13 in place. The battery compartment 29 is coupled to an inside surface 30 of the bottom wall 23 of the housing 11. In addition, the housing 11 is generally made of plastic.

In use, the housing 11 is clipped to the top inside surface 16 of a mailbox 17. The on/off switch 28 is then turned to its on position. When the door 20 to the mailbox 17 is opened, the door switch 14 is closed activating the light source 12 thereby illuminating the inside 19 of the mailbox 17. When the door 20 is closed, the door switch 14 is opened thereby deactivating the light source 12.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A mailbox light assembly comprising:

a housing, said housing having an upper surface adapted to abut a top inside surface of a standard mailbox;

a pair of clips for coupling said upper surface of said housing to said top inside surface of said mailbox;

a light source for providing illumination to an inside of said mailbox, said light source being positioned in said housing;

a power source for powering said light source, said power source being in electrical communication with said light source, said power source being positioned in said housing;

a normally closed pushbutton door switch for activating said light source, said door switch being electrically coupled between said light source and said power source, said door switch further being positioned to engage a door of said mailbox when said door is covering an opening to said inside of said mailbox;

wherein when said door is covering said opening to said mailbox said door switch is open and when said door is not covering said opening to said mailbox said door switch is closed thereby activating said power source; and an on/off switch for disconnecting the power source from the light source to conserve energy of the power source when not in use, said on/off switch being electrically coupled between said power source and said light source.

2. The mailbox light assembly of claim 1 further comprising:

said housing further having a front wall, a bottom wall, and an open back portion.

3. The mailbox light assembly of claim 1 further comprising:

each said clips having a first portion extending from said front wall of said housing proximate said upper surface of said housing, each said clip having a second portion for engaging an outside surface of said mailbox, said second portion being coupled generally perpendicular to said first portion proximate said upper surface of said housing, said second portion further being generally parallel to said upper surface of said housing, said clips being spaced a predetermined distance apart from each other.

4. The mailbox light assembly of claim 2 further comprising:

said light source further being positioned proximate said back portion.

5. The mailbox light assembly of claim 2 further comprising:

said door switch extending from said front wall of said housing.

6. The mailbox light assembly of claim 1 further comprising:

said on/off switch extending from a bottom wall of said housing for allowing manipulation of said on/off switch.

7. The mailbox light assembly of claim 1 further comprising:

a battery compartment for holding said power source, said battery compartment being received in said housing.

8. The mailbox light assembly of claim 7 further comprising:

said battery compartment being coupled to an inside surface of a bottom wall of said housing.

9. The mailbox light assembly of claim 1 further comprising:

said housing being generally made of plastic.

10. A mailbox light assembly comprising:

a housing, said housing having an upper surface adapted to abut a top inside surface of a standard mailbox, said housing further having a front wall, a bottom wall, and an open back portion;

a pair of clips for coupling said housing to said mailbox, each said clips having a first portion extending from said front wall of said housing proximate said upper surface of said housing, each said clip having a second portion for engaging an outside surface of said mailbox, said second portion being coupled generally perpendicular to said first portion proximate said upper surface of said housing, said second portion further being generally parallel to said upper surface of said housing, said clips being spaced a predetermined distance apart from each other;

a light source for providing illumination to an inside of said mailbox, said light source being positioned in said housing proximate said back portion;

a power source for powering said light source, said power source being in electrical communication with said light source, said power source being positioned in said housing;

a normally closed pushbutton door switch for activating said light source, said door switch being electrically coupled between said light source and said power source, said door switch extending from said front wall of said housing, said door switch further being positioned to engage a door of said mail box when said door is covering an opening to said mail box wherein when said door is covering said opening to said mailbox said door switch is open and when said door is not covering said opening to said mailbox said door switch is closed;

an on/off switch for disconnecting the power source from the light source to conserve energy of the power source when not in use, said on/off switch being electrically coupled between said power source and said light source;

said on/off switch extending from said bottom wall of said housing for allowing manipulation of said on/off switch;

a battery compartment for holding said power source, said battery compartment being coupled to an inside surface for said bottom wall; and said housing being generally made of plastic.

11. A mailbox light assembly comprising:

a housing, said housing having an upper surface abutting a top inside surface of a standard mailbox when installed;

a light source for providing illumination to an inside of said mailbox, said light source being positioned entirely within said housing;

a power source for powering said light source, said power source being in electrical communication with said light source, said power source being positioned in said housing: and a pair of clips for coupling said upper surface of said housing to said top inside surface of said mailbox;

each one of said pair of clips having a first portion extending from said front wall of said housing proximate said upper surface of said housing, each one of said pair of clips having a second portion for engaging an outside surface of said mailbox, said second portion being coupled generally perpendicular to said first portion proximate said upper surface of said housing, said second portion further being generally parallel to said upper surface of said housing, said clips being spaced a predetermined distance apart from each other.

12. The mailbox light assembly of claim 11, further comprising:

a normally closed pushbutton door switch for activating said light source, said door switch being electrically coupled between said light source and said power source, said door switch further being positioned to engage a door of said mailbox when said door is covering an opening to said inside of said mailbox; and wherein when said door is covering said opening to said mailbox said door switch is open and when said door is not covering said opening to said mailbox said door switch is closed thereby activating said power source.

13. The mailbox light assembly of claim 11, further comprising:

an on/off switch for disconnecting the power source from the light source to conserve energy of the power source when not in use, said on/off switch being electrically coupled between said power source and said light source.

* * * * *